US006276002B1

(12) United States Patent
Oschmann

(10) Patent No.: US 6,276,002 B1
(45) **Date of Patent: *Aug. 21, 2001**

(54) PARTITION FOR SHOWERS, IN PARTICULAR ROLLER BLIND

(76) Inventor: Eberhard Oschmann, Am Johannisberg 26, D-99887 Altenbergen (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/341,912

(22) PCT Filed: May 14, 1997

(86) PCT No.: PCT/EP97/02469

§ 371 Date: Sep. 27, 1999

§ 102(e) Date: Sep. 27, 1999

(87) PCT Pub. No.: WO98/31268

PCT Pub. Date: Jul. 23, 1998

(30) Foreign Application Priority Data

Jan. 20, 1997 (DE) ..... 197 01 777
Jan. 28, 1997 (DE) ..... 197 03 010

(51) Int. Cl.[7] ..... A47K 3/14
(52) U.S. Cl. ..... 4/558; 4/608

(58) Field of Search ..... 4/558, 608–610

(56) References Cited

U.S. PATENT DOCUMENTS 2,173,993 * 9/1939 Amdur ..... 4/558
2,212,326 * 8/1940 Piken ..... 4/558
5,333,664 * 8/1994 Sirianni et al. ..... 4/558 X

* cited by examiner

*Primary Examiner*—Charles E. Phillips
(74) *Attorney, Agent, or Firm*—St. Onge Steward Johnston & Reens LLC

(57) ABSTRACT

The present invention is directed to a shower partition, especially a shower blind, which has a housing adapted to be mounted substantially horizontally and open longitudinally on at least one side for guiding a rotary shaft, the shaft being used for receiving a splash guard sheet. Moreover, a mechanism is provided for winding and unwinding the splash guard sheet across the opening of the housing and a drop rod secured to the free end of the splash guard sheet. With the present invention, the splash guard sheet has a pocket formed at the free end thereof for accommodating the drop rod, the drop rod including segmented and/or flexibly interconnected drop rod segments such that the splash guard sheet may substantially follow the inner contour of a tub, shower tray or the like and may approximately adhere to the inside thereof.

5 Claims, 2 Drawing Sheets

PARTITION FOR SHOWERS, IN PARTICULAR ROLLER BLIND

FIELD OF THE INVENTION

Figure 1:
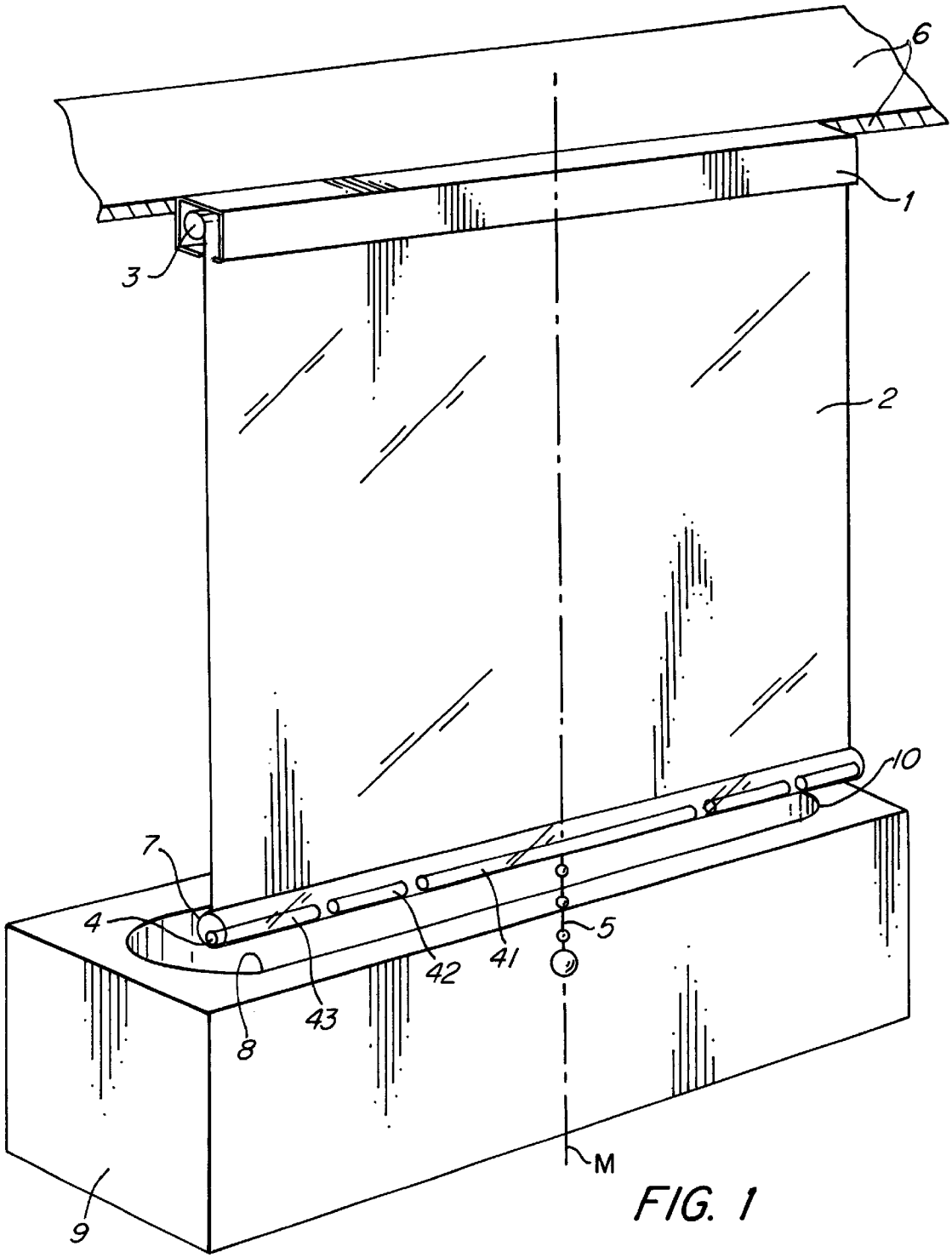

This invention is directed to a shower partition, especially a shower blind comprising a housing which is adapted to be mounted substantially horizontally and open longitudinally on at least one side for guiding a rotary shaft, the shaft being used for receiving a splash guard sheet, and comprising means for winding and unwinding the splash guard sheet across the opening of the housing, and comprising a drop rod secured to the free end of the splash guard sheet.

BACKGROUND OF THE INVENTION

German Utility Model G 8709165.8 discloses a shower curtain adapted to be wound up and including a horizontal winding shaft for winding and unwinding said shower curtain. Both ends of the shaft are rotatably mounted in respective mounting means and provided with an actuating means. For the purpose of winding the unwound shower curtain after use of the shower, the winding shaft may be configured as a spring blind, or in accordance with the above-mentioned Utility Model it may be connected with a driving gear having an endless driving chain or the like running therearound and being in engagement with said driving gear.

The end-side mounting means for the actuating means of known shower blinds may be arranged within a case adapted to be mounted on the ceiling and forming a housing. Due to the arrangement of the end-side mounting means and hence also the driving chain within the case a visually pleasing exterior as well as protection from environmental influences is achieved.

Moreover, the Utility Model G 8709165.8 teaches the provision of a metal rod sewn in at the free end of the shower curtain and intended to improve the unwinding and winding operation. The metal rod also serves as an end support for the shower curtain on the tub rim.

With the above-mentioned known solution the unwound shower curtain rests on the tub rim, and it is impossible to prevent splashed water from leaking out at the sides or across the tub rim so that problems in respect of moisture and cleaning will result.

Such a risk is particularly increased if the user of the shower has to move within the narrow available space for instance to reach for appropriate cleaning agents. In that case the unwound shower curtain will be moved and will slide across the tub rim so that at least drip water will get into the environment.

The German Patent Specification DE 2714595C2 is based on a shower screen comprising an elongated, horizontally mountable housing the interior of which is provided with a sheet member adapted to be wound and unwound.

The bottom end of the sheet member shown therein is provided with a stiffening rod having free sheet ends suspended therefrom. Subsequent to unwinding of the sheet member, the free sheet ends should be placed over the inside and the outside of a tub rim or a shower tray. This leads to considerable difficulties particularly in the case of tubs having curved areas, as may be the case at least in the head and/or foot area. Moreover, moving the free sheet ends requires some effort on the side of the user who will normally not be prepared to expend such effort, so that moisture will leak into the bathroom or the environment also with a shower screen of the specified design. Finally, the free sheet ends are liable to damage especially in the longitudinal or transverse direction.

The present applicant's Utility Model G 9214429.2 discloses a cartridge-type shower blind used for the hidden reception of an unwindable shower sheet. The cartridge-type shower blind described therein may either be installed in a false ceiling or it may be mounted below the ceiling. The cartridge for receiving the blind is formed of extruded aluminum, and within the cartridge a shaft for the blind is rotatably supported. A drop rod provided therein improves winding and unwinding of the sheet member or blind, respectively. With the shower blind according to Utility Model G 9214429.2 it is also possible for splash water to leak from the sides, or there is a risk of the sheet resting on the tub rim to be moved beyond said rim so that splash water will get into the environment. Basically, however, it is possible to choose the width of the shower blind in such a way that the free end of the blind may be pulled into the tub. But in that case the free space available when having a shower is unacceptably restricted by the curved areas of the tub so that the advantages otherwise obtained with the blind are cancelled.

The blind for use in a bath and shower area according to the Utility Model G 9304750.9 is based on a commercially available product adapted for mounting in a longitudinally cut aluminum tube. For showering, the cloth of the blind is pulled down right to the tub rim so that any splash water will drain into the tub. But in this case also the available space for unobstructed showering in the tub is restricted, in particular when the blind according to G 9304750.9 is tailored to match the maximum length of the tub.

SUMMARY OF THE INVENTION

It is therefore the aim of the present invention to provide an improved shower partition, particularly a shower blind, comprising a housing adapted to be mounted substantially horizontally and open longitudinally on at least one side for guiding a rotary shaft and for receiving a splash guard sheet; this shower partition is intended to ensure, on the one hand, that no splash water will leak to the environment and that on the other hand the normally restricted space for taking a shower in a tub or shower tray is not still further restricted by the blind. The blind in accordance with the present invention is adapted to be pulled down right beneath the rim of the tub or shower tray, because in this position any slipping-out of the free end of the blind over the rim of the tub or tray due to an accidental sidewise movement can be safely prevented.

The objective of the present invention is achieved with the basic concept of the present invention which starts out from a specific sectionalized or segmented drop rod. Due to the subdivision of the drop rod the sheet of the blind or the splash guard sheet, respectively, may fit closely against the inner side of a tub usable as a shower, and the splash water may accordingly drain into the tub. Due to the drop rod or the segmentation thereof in accordance with the present invention the sheet will match the interior contour of the tub or the tub shape, respectively. It has surprisingly been found that due to the sliding motion of the blind with the segmented drop rod into a tub portion the splash guard sheet is able to follow any curvatures of the interior contour so that there is sufficient space for taking a shower and, as explained above, the splash water may safely drain off.

Especially if the inside of the tub and/or shower tray includes some residual moisture the splash guard sheet provided with the special segmented drop rod will adhere to the tub instead of the body, so that any unintentional lateral sliding out or slipping out of the sheet due to some movement of the person taking a shower is safely prevented.

In accordance with the present invention the splash guard sheet comprises a pocket formed at the free end thereof for receiving the segmented drop rod. Instead of being segmented, or in combination with such a measure, the drop rod may comprise flexibly interconnected drop rod portions, the overall objective being to permit positioning of the splash guard sheet in such a way that the sheet may follow the interior contours of a tub, shower tray or the like and fit closely against the inside thereof. Also, a drop rod may be employed which is clamped or adhesively joined to the sheet or which is in contact therewith by way of a compression joint, in which case the pocket need not be provided.

In accordance with a specific structural concept of the present invention, segmented drop rod portions are provided only at the lateral ends of the splash guard sheet inside the mentioned pocket.

In a concrete embodiment of the present invention, a first drop rod portion is provided starting symmetrically and nearly equally distributed from the central longitudinal axis of the splash guard sheet. This first drop rod portion takes up a length of substantially from 30 to 70% of the sheet width. Second and/or third or further drop rod portions are provided laterally on either side on the first portion and contiguous therewith. Said second and third drop rod portions as a whole fill the remaining width of the sheet and are divided between the second and the third portion at a ratio of substantially from 1:1 to 3:1. Other dividing ratios are conceivable. Likewise, the drop rod may be constituted by a chain or chain members.

Advantageously, the drop rod segments or the drop rod, respectively, are made of non-corroding metal such as aluminum, stainless steel or a plastics material of corresponding mass.

In an embodiment of the present invention the drop rod exhibits flexible characteristics along its longitudinal extension, and in this case magnetic rubber material is particularly employed for the drop rod. The magnetic rubber material, which may also be used as a coating material for a segmented metallic drop rod, increases the desirable adhesion along the inside or the inner wall of a metallic tub, shower tray or the like.

The housing is longitudinally divided for improved assembly or easy maintenance of the shower partition of the present invention. A first housing member comprises means such as bores for mounting at, in or on a mounting surface, and a second housing member lines or covers the remaining surfaces. According to the present invention the first and second housing members are interconnected by way of longitudinal tongue-and-groove means and end caps disposed on the sides. The end caps, which are preferably constituted by molded plastics parts, include means for guiding the shaft of the blind.

The pocket for receiving the drop rod segments, which as a whole constitute a drop rod, is formed by folding back a bottom end and by welding a special splash-guard plastics sheet.

A further developed embodiment of the present invention is based on a housing of any desired cross-sectional shape which is constituted by individual housings adapted to be angularly arranged, each subhousing being provided with a splash guard sheet comprising segmented and/or flexibly interconnected drop rod portions.

Considered overall, the present invention provides a surprisingly simple way of ensuring that the bottom end of a shower blind cannot slip away from the tub rim and/or shower tray rim even upon movement of the person taking a shower, so that splash water is efficiently collected. Due to the special embodiment of the housing in combination with the tongue-and-groove structure and the resulting divisibility, mounting of the shower partition is considerably facilitated while the desired stability of the overall arrangement during frequent use and hence the service life are not impaired.

Accordingly, the advantage of the drop rod of the present invention resides in that it is possible due to the segmented configuration to achieve matching with the shape of the tub or shower tray, respectively. Also in case of a straight housing which is mounted on a mounting surface such as a bathroom ceiling in accordance with the longitudinal extension of a tub, it is possible to obtain lateral protection from splash water in the area of the tub curvature, because due to the division of the drop rod, i.e. the segmented drop rod, the sheet will be able at least at one lateral end to follow the curvature sideways.

Figure 2:
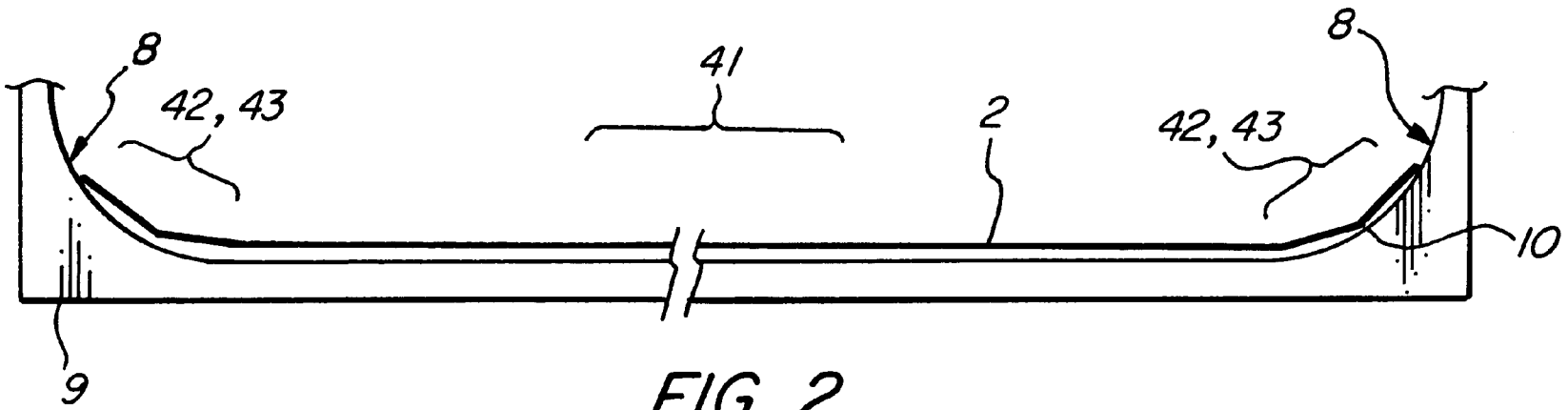

Below, the present invention will be described in detail by reference to an embodiment thereof and to the accompanying drawings, in which:

FIG. 1 is a basic diagram showing the shower partition in a state in which it is not yet fully unwound, and FIG. 2 is a plan view showing an unwound shower partition which closely fits the inside of a tub in side areas thereof.

BRIEF DESCRIPTION OF THE PREFERRED EMBODIMENT

The fundamental embodiment of the shower partition illustrated in FIG. 1 is based on a horizontally mounted housing 1. Said housing 1 is joined to the bathroom ceiling 6 through suitable fasting means.

The interior of the housing 1 accommodates a rotary shaft 3 used for mounting a splash guard sheet which is adapted to be wound and unwound. In the illustrated embodiment the splash guard sheet 2 comprises a pull chain 5. Alternatively, a laterally disposed endless chain may be provided which co-operates with the rotary shaft 3 via a corresponding driving gear (not illustrated).

At the free end of the splash guard sheet 2 a pocket 7 is provided. This pocket 7 is used to receive a special segmented drop rod 4.

The segmented drop rod 4 illustrated in FIG. 1 comprises a first drop rod segment 41 which, starting from the central longitudinal axis M of the splash guard sheet 2, is arranged symmetrically towards either side. A second drop rod segment 42 and a third drop rod segment 43 are respectively provided on either side of the first drop rod segment 41 adjacent thereto. The length of said second and third drop rod segments 42; 43 is smaller than the length of the first, central drop rod segment 41. The length of the drop rod segments is selected in accordance with the curved areas 8 of the tub 9.

Generally, it has been found that within the lateral end portions of the splash guard sheet 2 the number of drop rod segments increases while their individual lengths decrease. Moreover, the third drop rod segments may also be of shorter length than the second drop rod segments.

In a preferred embodiment there are provided first drop rob segments taking up a length of from 30 to 70% of the respective sheet width. The second and third drop rod segments 42; 43, which are adjacent the first drop rod segment 41 on either side thereof, as it were fill the remaining width of the splash guard sheet 2 or the pocket 7 provided at the bottom end of the sheet 2, respectively.

The second and third drop rod segments 42; 43 are divided at a ratio of substantially from 1:1 to 3:1 between the second and the third segment.

In the illustration of FIG. 1 the splash guard sheet 2 is not yet in the final state, i.e. the sheet 2 may be pulled down by means of the pull chain 5 right below the tub rim 10 into the tub 9, so that the bottom end of the splash guard sheet 2 may follow the internal contour of the tub 9 particularly in the area of the curvatures 8.

The material of the drop rods or drop rod segments exhibits antirust properties, and it is preferred to employ an aluminum rod. Additionally, the aluminum rod may be provided with a magnetic rubber sheath as shown in FIG. 3 schematically illustrating this structure which is shown in proportions that do not purport to correspond to the actual size of the structure so that especially in the case of metallic tubs and/or shower trays improved adhesion of the splash guard sheet 2 to the inside of the respective tub will be achieved.

In a further embodiment the individual drop rod segments may be hinged to each other and exhibit resilient or elastic properties so that subsequent to sliding of the splash guard sheet 2 from the tub 9, i.e. subsequent to rewinding, the original elongated shape will be obtained again so that the return of the splash guard sheet 2 into the housing 1 will take place smoothly.

The housing 1 may be divided longitudinally so that first and second housing members result. A first housing member may be provided with bores which together with suitable bolts are used to mount the member to the bathroom ceiling 6. The first and second housing members are then joined preferably by way of tongue and groove means wherein lateral end caps (not illustrated in FIG. 1) are provided both for accommodating the shaft and securing the housing members to each other.

As will be apparent from the basic view of FIG. 1 the width of the splash guard sheet 2 may be selected to be greater than a straight portion of the tub 9 so that due to the segmented structure of the drop rod 4 the bottom portion of the splash guard sheet 2 will fit the inner wall closely to thereby copy the internal contour of the tub. This considerably improves the splash guarding effect while free movement of the user is not restricted with the blind being unwound.

Of course, it is possible to provide segmented drop rod ends on one side only when the overall width of the splash guard blind 2 is selected to be smaller in comparison to the overall length of the tub 9.

As an alternative, the housings may be composed of individual housings adapted to be angled at the corners. In that case each individual housing is provided with a splash guard sheet comprising segmented and/or flexibly joined drop rods or drop rod segments, respectively. With this embodiment the actuating means may be provided separately, or as an alternative it is possible to hingedly interconnect the respective rotary shafts provided in such a case, so that winding and unwinding of the splash guard sheets will be possible by means of a single pull device.

The plan view of FIG. 2 is based on a fully unwound splash guard sheet 2 which is below the rim 10 of a tub 9 and adheres to the inside by following the interior contour thereof.

The bottom side of the splash guard sheet 2 which is provided with the respective drop rod segments 41 to 43 approximately follows the curved area 8 of the tub 9.

The shower partition explained by way of the embodiments and particularly a shower blind implemented in this way is based—in contrast to the prior art—on a divided drop rod which is disposed within a closed pocket of the splash guard sheet. Therefore the pocket accommodates drop rod segments which may also be flexibly interconnected.

Advantageously, the pocket for accommodating the segmented drop rod or the drop rod segments is realized by folding over and welding a bottom end of the sheet.

On account of the drop rod segments the splash guard sheet may substantially follow the inner contour of a tub, shower tray, basin or the like and adhere to the inside thereof. As it were, the drop rod segments approximate the contour of the tub, shower tray or the like.

What is claimed is:

1. A shower partition, comprising:

a substantially horizontally mountable housing open on at least one longitudinal side for supporting a rotary shaft, said shaft being used to receive a splash guard sheet having a width, and having means for winding and unwinding said splash guard sheet across the open side of the housing, and having a drop rod secured at a free end of the splash guard sheet, characterized in that the free end of said splash guard sheet has a pocket formed therein and filled with the drop rod which continuously extends along the full width of the splash guard sheet, wherein said drop rod consists of:

a one-piece first segment received in the pocket having opposite ends spaced from opposite sides of the free end and taking up a length of at least 50% of the full splash guard sheet width, and at least two second segments received in said pocket laterally adjacent to the opposite ends of and extending from the first segment in opposite directions to terminate at the opposite sides of the free end and to fill the remaining width of the splash guard sheet, so as to enable the free end to be stretched at the full width during winding and unwinding of the splash guard sheet and to substantially follow the inner contour of a tub upon unwinding below a tub rim.

2. The shower partition as claimed in claim 1, wherein the inner contour of the tub includes curved regions.

3. The shower partition as claimed in claim 1, characterized in that, starting from a central longitudinal axis (M) of said splash guard sheet, the first segment is symmetrically provided and takes up a length of up to 70% of the sheet width, said two second segments having first and second length, respectively, said first and second lengths have a length ratio varying between 1:1 to 1:3.

4. The shower partition as claimed in claim 1, characterized in that the drop rod segments are made from a rustproof material.

5. The shower partition as claimed in claim 1, characterized in that at least parts of individual drop rod segments are either coated or provided with a magnetic material so as to improve adhesion to the tub.

* * * * *